US010519742B2

(12) United States Patent
Krüger

(10) Patent No.: US 10,519,742 B2
(45) Date of Patent: Dec. 31, 2019

(54) DOWNHOLE COMPLETION WITH ENCLOSED SENSOR

(71) Applicant: Welltec Oilfield Solutions AG, Zug (CH)

(72) Inventor: Christian Krüger, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 15/608,432

(22) Filed: May 30, 2017

(65) Prior Publication Data

US 2017/0342799 A1 Nov. 30, 2017

(30) Foreign Application Priority Data

May 30, 2016 (EP) ..... 16171923
Jun. 22, 2016 (EP) ..... 16175660

(51) Int. Cl.
*E21B 47/01* (2012.01)
*E21B 33/128* (2006.01)
(Continued)

(52) U.S. Cl.
CPC ..... *E21B 33/1285* (2013.01); *E21B 23/06* (2013.01); *E21B 23/08* (2013.01); *E21B 47/06* (2013.01); *E21B 33/1208* (2013.01)

(58) Field of Classification Search
CPC combination set(s) only.
See application file for complete search history.

(56) References Cited

U.S. PATENT DOCUMENTS 4,134,453 A * 1/1979 Love ..... E21B 43/114 166/298
6,234,257 B1 * 5/2001 Ciglenec ..... E21B 7/06 166/250.01

(Continued)

FOREIGN PATENT DOCUMENTS

CN 204 371 260 6/2015
CN 204371260 U 6/2015

(Continued)

OTHER PUBLICATIONS

Extended Search Report for EP16171923.2 dated Aug. 26, 2016, 7 pages.

(Continued)

*Primary Examiner* — Taras P Bemko
*Assistant Examiner* — Ronald R Runyan
(74) *Attorney, Agent, or Firm* — Nixon & Vanderhye P.C.

(57) ABSTRACT

The present invention relates to a downhole completion device configured to be mounted as part of a well tubular metal structure. The downhole completion device comprises a housing enclosing a closed space, an electrical component arranged in the space inside the housing, the housing being filled with a liquid having a first volume of 1 bar at 20° C., wherein the housing has a first housing section and a second housing section, the first housing section having a first thickness and the second housing section having a second thickness, and the second thickness being smaller than the first thickness so that the second housing section is more flexible than the first housing section. Furthermore, the invention relates to a downhole completion system.

15 Claims, 3 Drawing Sheets

Figure 1:
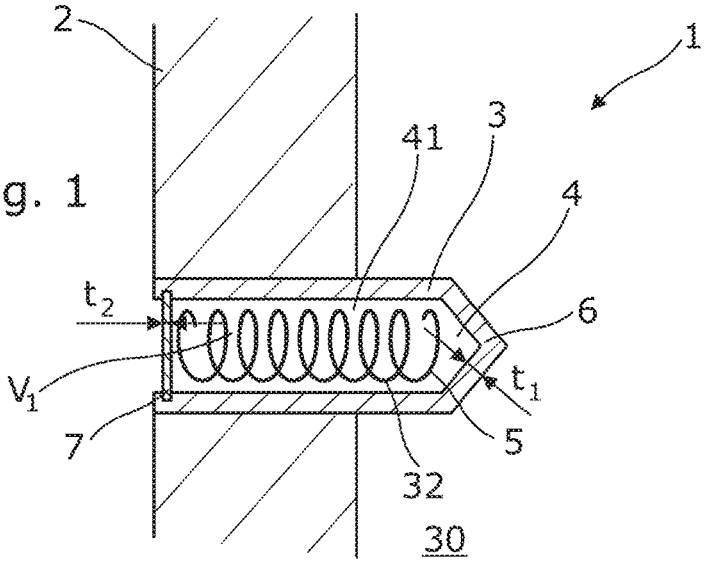

(51) Int. Cl.

| | |
|---|---|
| ***E21B 23/06*** | (2006.01) |
| ***E21B 23/08*** | (2006.01) |
| ***E21B 47/06*** | (2012.01) |
| *E21B 33/12* | (2006.01) |

(56) References Cited

U.S. PATENT DOCUMENTS

| | | | | |
|---|---|---|---|---|
| 2004/0231861 | A1* | 11/2004 | Whanger | E21B 33/127 166/387 |
| 2004/0238166 | A1* | 12/2004 | Salamitou | E21B 47/01 166/255.1 |
| 2005/0194185 | A1* | 9/2005 | Gleitman | E21B 17/003 175/45 |
| 2005/0248334 | A1 | 11/2005 | Dagenais et al. | |
| 2008/0066555 | A1* | 3/2008 | Rezgui | G01L 9/0055 73/716 |
| 2008/0238427 | A1* | 10/2008 | Clark | G01V 3/20 324/347 |
| 2012/0203478 | A1* | 8/2012 | Smaidris | G01F 23/165 702/55 |
| 2017/0174506 | A1* | 6/2017 | Gianchandani | B81B 7/0048 |

FOREIGN PATENT DOCUMENTS

| | | |
|---|---|---|
| EP | 2 876 251 | 5/2015 |
| WO | WO 2008/034761 | 3/2008 |
| WO | WO 2015/069721 | 5/2015 |

OTHER PUBLICATIONS

International Search Report and Written Opinion of the International Search Authority dated Jul. 11, 2017 in International Application No. PCT/EP2017/062945 (12 pages).

* cited by examiner

DOWNHOLE COMPLETION WITH ENCLOSED SENSOR

This application claims priority to EP Patent Application No. 16171923.2 filed May 30, 2016 and EP Patent Application No. 16175660.6 filed Jun. 22, 2016, the entire contents of each of which are hereby incorporated by reference.

The present invention relates to a downhole completion device configured to be mounted as part of a well tubular metal structure. Furthermore, the invention relates to a downhole completion system.

When having electrical components downhole, such as a pressure or temperature sensor, the sensor is subjected to both high temperature and high pressure. The sensor is often comprised in a housing, but when the temperature in the well increases, the pressure in the housing also increases, which jeopardises the functionality of the sensor.

It is an object of the present invention to wholly or partly overcome the above disadvantages and drawbacks of the prior art. More specifically, it is an object to provide an improved downhole completion device which is able to house and protect an electrical component to prevent its functionality from deteriorating.

The above objects, together with numerous other objects, advantages and features, which will become evident from the below description, are accomplished by a solution in accordance with the present invention by a downhole completion device configured to be mounted as part of a well tubular metal structure, comprising:

a housing enclosing a closed space, an electrical component arranged in the space inside the housing, the housing being filled with a liquid having a first volume of 1 bar at 20° C., wherein the housing has a first housing section and a second housing section, the first housing section having a first thickness and the second housing section having a second thickness, and the second thickness being smaller than the first thickness so that the second housing section is more flexible than the first housing section.

In this way, the electrical component is protected from any temperature and pressure changes that naturally occur downhole in a well during production, fracturing, aciding, gas lifting or other activities taking place downhole during the service life of a well.

The housing described above may be pre-filled with the liquid.

Also, the housing may be filled with liquid before being mounted as part of the well tubular metal structure.

In addition, the housing may be a metal housing.

Furthermore, the housing may partially be a metal housing.

Additionally, the first housing section may be of metal.

Moreover, the second housing section may be made of a non-metallic material, such as rubber, polymer or elastomer. The non-metallic material may also be fiberglass or the non-metallic material may be reinforced with e.g. fiberglass.

In addition, the second housing section may be made of a non-magnetic material.

Furthermore, the electrical component may be a sensor.

In addition, the sensor may be configured to measure temperature, pressure or other conditions of the fluid in the well.

Also, the electrical component may be a piezoelectric element, a strain gauge, a coil, an anemometer or an antenna, such as Bluetooth or WIFI.

Furthermore, the electrical component may be an inductive coupler.

The electrical component described above may also be a coil.

The downhole completion device may further comprise both an electrical component being a senor and an electrical component being a piezoelectric element, a strain gauge, a coil, an anemometer or an antenna, such as Bluetooth or WIFI.

Moreover, the second thickness may be less than 50% of the first thickness, preferably less than 33% of the first thickness, and more preferably less than 25%.

The second thickness may be less than 5 mm, preferably less than 3 mm, and more preferably less than 1 mm.

Further, the housing may have an outer face and the outer face may be provided with a thread.

Additionally, the liquid may be silicone, grease or any liquid suitable for electrical components.

The liquid may also be an electric insulating liquid suitable for electrical components.

Also, the housing may have a third housing section having a third thickness, the third thickness being smaller than the first thickness.

Moreover, the second housing section may have a projected state in which the liquid has a second volume being larger than the first volume, and a retracted state in which the liquid has a third volume being smaller than the first volume.

The downhole completion device may further comprise a communication unit connected with the electrical component.

In addition, the downhole completion device may further comprise a storage unit connected with the electrical component.

Also, the downhole completion device may further comprise a power supply arranged in the space.

Furthermore, the housing may comprise a filling nozzle.

The present invention furthermore relates to a downhole completion system comprising:

a well tubular metal structure arranged in a borehole of a well, the well tubular metal structure having a longitudinal axis and a wall, and a downhole completion device as described above, mounted as part of the well tubular metal structure.

The downhole completion device may be configured to be mounted in the well tubular metal structure.

Furthermore, the downhole completion device may be configured to be mounted on an outer face of the well tubular metal structure.

Also, the downhole completion device may be configured to be mounted on an inner face of the well tubular metal structure.

Moreover, the housing of the downhole completion device and the outer face of the well tubular metal structure may enclose the space.

In addition, the electrical component may abut the outer face of the well tubular metal structure.

Further, the downhole completion device may have a longitudinal extension which is perpendicular to the longitudinal axis and extends radially from the longitudinal axis.

Additionally, the downhole completion device may extend through the wall of the well tubular metal structure.

Furthermore, the downhole completion device may extend through the wall of the well tubular metal structure in a sealing manner.

Moreover, the downhole completion device may at least partly project from the outer face of the well tubular metal structure.

The downhole completion system may further comprise a downhole tool for communication with the downhole completion device.

Finally, the well tubular metal structure may comprise one or more annular barriers, each annular barrier comprising:

- a tubular metal part for mounting as part of the well tubular metal structure, the tubular metal part having a first expansion opening and an outer face,
- an expandable metal sleeve surrounding the tubular metal part and having an inner face facing the tubular metal part and an outer face facing a wall of the borehole, each end of the expandable metal sleeve being connected with the tubular metal part, and
- an annular space between the inner face of the expandable metal sleeve and the tubular metal part, the expandable metal sleeve being configured to expand when pressurised fluid is injected into the annular space through the first expansion opening.

Figure 2:
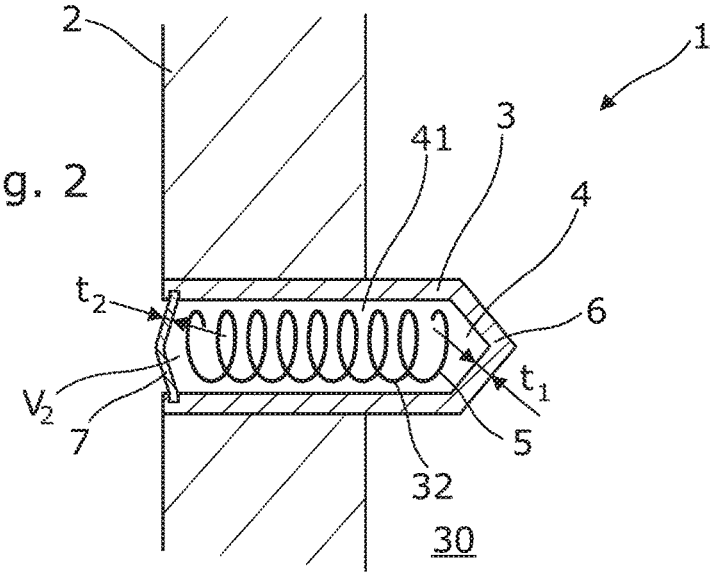
Figure 3:
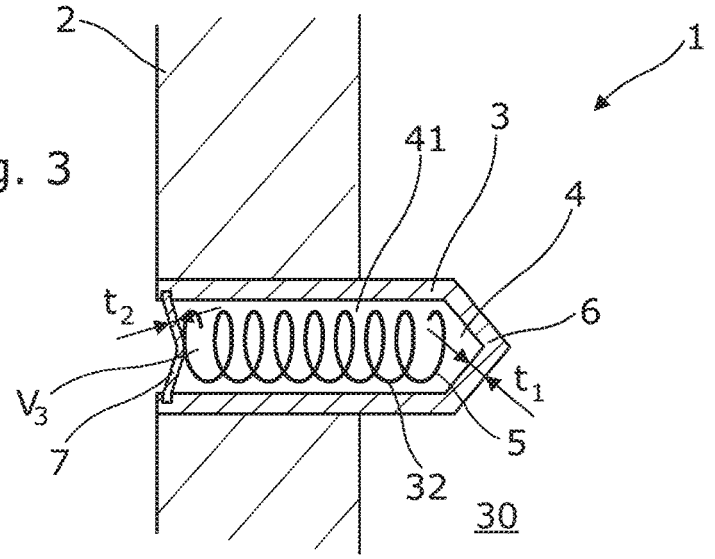
Figure 4:
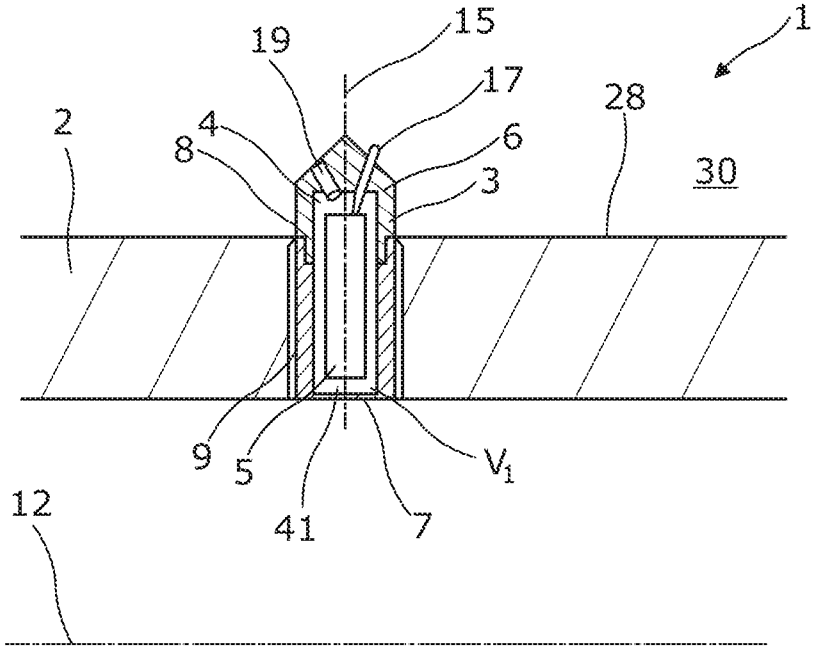
Figure 5:
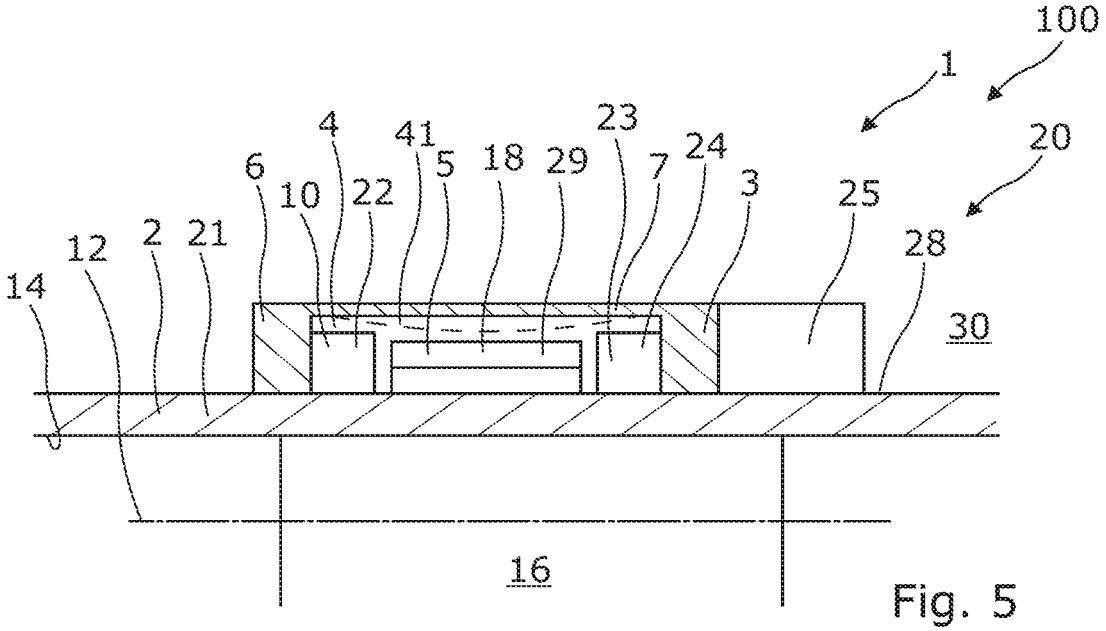
Figure 6:
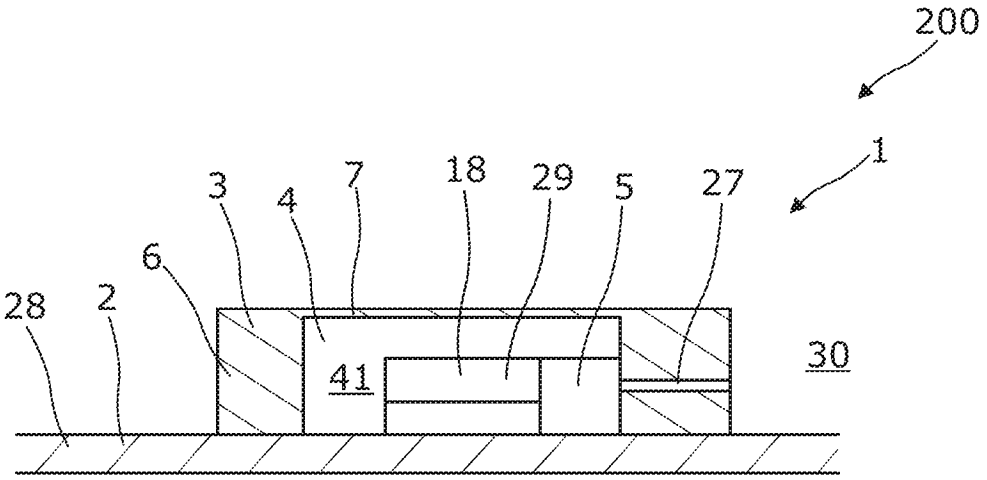
Figure 7:
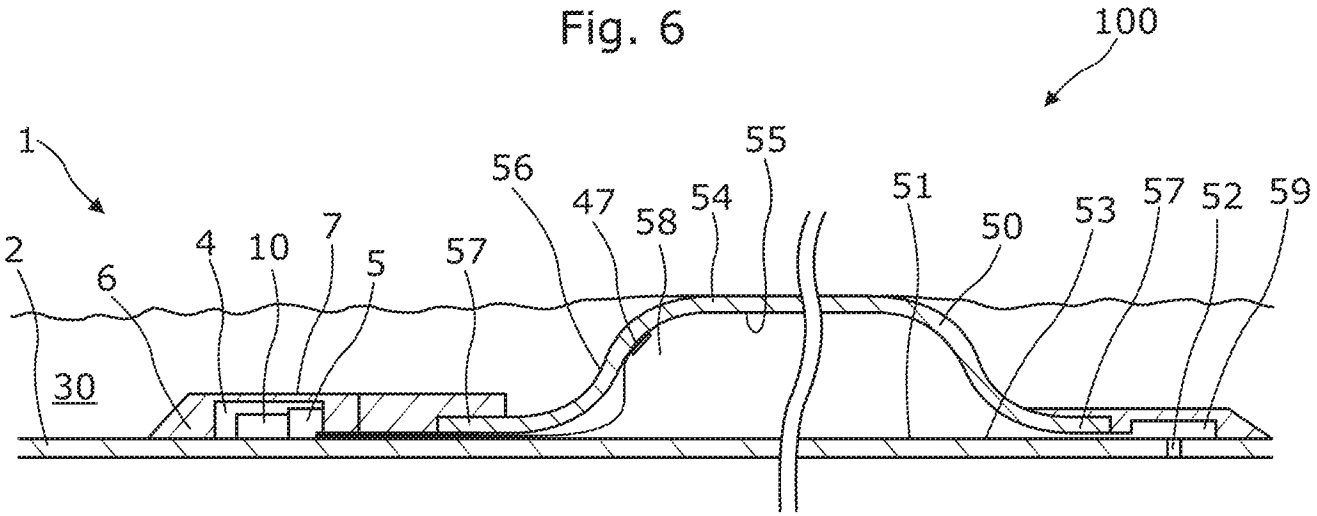

The invention and its many advantages will be described in more detail below with reference to the accompanying schematic drawings, which for the purpose of illustration show some non-limiting embodiments and in which FIG. 1 shows a cross-sectional view of a downhole completion device mounted in a well tubular metal structure, FIGS. 2 and 3 show the downhole completion device of FIG. 1 in a projected and a retracted state, respectively, FIG. 4 shows a cross-sectional view of another downhole completion device, FIG. 5 shows a cross-sectional view of a downhole completion device mounted outside the well tubular metal structure, FIG. 6 shows a cross-sectional view of another downhole completion device mounted outside the well tubular metal structure, and FIG. 7 shows a cross-sectional view of a downhole completion system having an annular barrier.

All the figures are highly schematic and not necessarily to scale, and they show only those parts which are necessary in order to elucidate the invention, other parts being omitted or merely suggested.

FIG. 1 shows a downhole completion device 1 configured to be mounted as part of a well tubular metal structure 2 in a borehole 30. The downhole completion device 1 comprises a housing 3 enclosing a closed space 4 and an electrical component 5, such as a coil 32, arranged in the space inside the housing. The housing 3 is filled with a liquid 41 having a first volume $V_1$ of 1 bar at 20° C. The housing 3 has a first housing section 6 and a second housing section 7. The first housing section 6 has a first thickness $t_1$ and the second housing section 7 has a second thickness $t_2$, the second thickness being smaller than the first thickness so that the second housing section is more flexible than the first housing section. When the temperature in the well increases, the pressure inside the closed space 4 increases accordingly. This causes the second housing section 7 to bulge radially outwards into the inside of the well tubular metal structure 2, as shown in FIG. 2, to a projected state of the second housing section in which the liquid 41 has a second volume $V_2$ which is larger than the first volume. When the pressure decreases, the second housing section 7 bulges radially inwards to a retracted state in which the liquid 41 has a third volume $V_3$ which is smaller than the first volume, as shown in FIG. 3. The electrical component 5 is hereby protected from any temperature and pressure changes that naturally occur downhole in a well during production, fracturing, aciding, gas lifting or other activities taking place downhole during the service life of a well.

Known sensors are filled with gas, such as air, and during insertion of the well tubular metal structure, the sensors are exposed to a lot of bumps, and often, the sensors no longer work when the well is completed because they were not capable of withstanding these bumps. By the present invention, the liquid inside the downhole completion device 1 surrounds the electrical component and thereby protects the electronics from these bumps during installation of the well tubular metal structure since the liquid fills out the space and has a substantially dampening effect when such bumps and shakings occur.

The second housing section 7 may be made of metal or a non-metallic material, such as rubber or elastomer. The second housing section 7 is in FIGS. 1-3 a separate part fastened to the first housing section 6, and in FIG. 4, the second housing section 7 is made as a thinner part of the housing 3 and not as a separate part. In FIG. 4, the second thickness is less than 50% of the first thickness, and the second housing section 7 is made of the same material as the first housing section 6. The second thickness may be less than 5 mm, preferably less than 3 mm, and more preferably less than 1 mm. The downhole completion device 1 extends through a wall of the well tubular metal structure 2 and partly projects from the outer face 28 of the well tubular metal structure 2. The downhole completion device 1 has a longitudinal extension 15 being perpendicular to a longitudinal axis 12 and extends radially from the longitudinal axis. Furthermore, the electrical component 5 is a sensor, such as an anemometer having a hot wire 17, extending from the housing 3 into the borehole 30 and is thus in connection with the well fluid. The housing 3 has an outer face 8, and the outer face is provided with a thread 9. The housing 3 comprises a filling nozzle 19 or filling plug for filling the space 4 with liquid, such as silicone, grease or a similar liquid suitable for electrical components.

In FIG. 5, the electrical component 5 is a piezoelectric element 29 which also functions as a communication unit 18. The downhole completion device 1 further comprises an energy harvesting unit 22 functioning as a power supply 10 for supplying power to the electrical component 5. The downhole completion device 1 further comprises a control unit 23 having a storage unit 24 for storing data, e.g. from a sensor 25 arranged outside the downhole completion device 1, or for controlling the communication from the communication unit 18. Thus, the electrical component 5 may be connected with the communication unit 18, the energy harvesting unit 22, the power supply 10, the control unit 23 or the storage unit 24. The energy harvesting unit 22 may obtain energy from a downhole tool 16, and the downhole tool 16 may also communicate with the downhole completion device 1.

In FIG. 6, the electrical component 5 is a sensor having access via a line 27 to measure a condition, such as temperature or pressure, of the well fluid in the borehole 30. The electrical component 5 may also be a strain gauge.

In FIG. 5, a downhole completion system 100 is shown comprising a well tubular metal structure 2 arranged in a borehole 30 of a well 20. The well tubular metal structure 2 has a longitudinal axis 12 and a wall 21. The downhole completion system 100 further comprises a downhole completion device 1 mounted as part of the well tubular metal structure 2 on an outer face 28 of the well tubular metal structure. The downhole completion device 1 may also be mounted on an inner face 14 of the well tubular metal structure 2. In FIGS. 5 and 6, the housing 3 of the downhole completion device 1 and the outer face 28 of the well tubular metal structure 2 enclose the space. In this way, the electrical component 5, being the piezoelectric element 29, abuts and has direct contact to the outer face 28 of the well tubular metal structure 2 in order to communicate and/or harvest energy.

In FIG. 7, the well tubular metal structure 2 of the downhole completion system 100 comprises an annular barrier 50. The annular barrier 50 comprises a tubular metal part 51 for mounting as part of the well tubular metal structure 2. The tubular metal part 51 has a first expansion opening 52 and an outer face 53. The annular barrier 50 further comprises an expandable metal sleeve 54 surrounding the tubular metal part 51 and having an inner face 55 facing the tubular metal part and an outer face 56 facing a wall of the borehole 30. Each end 57 of the expandable metal sleeve 54 is connected with the tubular metal part 51, thereby defining an annular space 58 between the inner face 55 of the expandable metal sleeve and the tubular metal part. The expandable metal sleeve 54 is expanded by letting pressurised fluid into the annular space through the first expansion opening 52 and further through an expansion unit 59. A strain gauge 47 is mounted on the expandable metal sleeve 54 and is electrically connected with the electrical component 5 inside the space 4 for measuring the expansion of the expandable metal sleeve of the annular barrier 50. The downhole completion device 1 further comprises a power supply 10, such as a battery, for powering the electrical component 5.

Even though not shown, the downhole completion device 1 of FIG. 4 may further comprise a power supply, such as a battery, and the electrical component inside the space may comprise both a coil and/or an antenna, such as Bluetooth. The coil is used for receiving power to charge the battery and the antenna is used for communicating sensor data.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole completion system comprising:

a well tubular metal structure configured to be arranged in a borehole of a well, the well tubular structure having a wall with a through-bore extending radially relative to a longitudinal axis of the well tubular metal structure, and a downhole completion device having a housing enclosing a sealed, closed space subject to temperature and/or pressure induced volume changes, the housing being fixedly arranged in the through-bore of the well tubular structure, and an electrical component with a sensor arranged in the space inside the housing, the housing being filled with a liquid having a first volume at 1 bar at 20° C., wherein the housing has a first housing section attached inside the though bore of the well tubular structure and a second housing section attached to or formed as part of the first housing section, the second housing section being positioned at a proximal end of the first housing section that is within the through-bore in use, so that the second housing section spans at least part of the through-bore, the first housing section having a first thickness and the second housing section having a second thickness, and the second thickness being smaller than the first thickness so that the second housing section is more flexible than the first housing section, thus protecting the electrical component and sensor from pressure and/or temperature changes downhole while the sensor is configured to measure temperature, pressure or other conditions of the fluid in the well.

2. The downhole completion system according to claim 1, wherein the second housing section is made of a non-metallic material.

3. The downhole completion system according to claim 1, wherein the housing has an outer face and the outer face is provided with a thread.

4. The downhole completion system according to claim 1, wherein the liquid is silicone, grease or any liquid suitable for electrical components.

5. The downhole completion system according to claim 1, wherein the second housing section has a projected state in which the liquid has a second volume being larger than the first volume, and a retracted state in which the liquid has a third volume being smaller than the first volume.

6. The downhole completion system according to claim 1, further comprising a communication unit connected with the electrical component.

7. The downhole completion system according to claim 1, further comprising a power supply arranged in the space.

8. The downhole completion system according to claim 1, wherein the downhole completion device is configured to be mounted in the well tubular metal structure.

9. The downhole completion system according to claim 1, wherein the downhole completion device extends through the wall of the well tubular metal structure.

10. The downhole completion system according to claim 1, wherein the downhole completion device at least partly projects from the outer face of the well tubular metal structure.

11. The downhole completion system according to claim 1, further comprising a downhole tool for communication with the downhole completion device.

12. The downhole completion system according to claim 1, wherein the sensor is configured to sense pressure or temperature.

13. The downhole completion system according to claim 1, wherein the second housing section is configured to bend inwards towards the closed space to accommodate volume changes due to pressure and/or temperature changes.

14. The downhole completion system according to claim 1, wherein a piezoelectric element, a strain gauge, a coil, an anemometer or an antenna is arranged in the space inside the housing.

15. The downhole completion system according to claim 14, wherein the antenna is arranged inside the housing, the antenna comprising Bluetooth or WIFI.

* * * * *